US009484014B1

(12) United States Patent
Kaszczuk et al.

(10) Patent No.: US 9,484,014 B1
(45) Date of Patent: Nov. 1, 2016

(54) HYBRID UNIT SELECTION / PARAMETRIC TTS SYSTEM

(71) Applicant: Amazon Technologies, Inc., Reno, NV (US)

(72) Inventors: Michal Tadeusz Kaszczuk, Gdansk (PL); Lukasz Maciej Osowski, Gdynia (PL)

(73) Assignee: Amazon Technologies, Inc., Seattle, WA (US)

( * ) Notice: Subject to any disclaimer, the term of this patent is extended or adjusted under 35 U.S.C. 154(b) by 217 days.

(21) Appl. No.: 13/771,545

(22) Filed: Feb. 20, 2013

(51) Int. Cl.
*G10L 13/08* (2013.01)

(52) U.S. Cl.
CPC ..... *G10L 13/086* (2013.01)

(58) Field of Classification Search
USPC ..... 704/260
See application file for complete search history.

(56) References Cited

U.S. PATENT DOCUMENTS

| | | | | |
|---|---|---|---|---|
| 2006/0095264 | A1* | 5/2006 | Wu et al. | 704/260 |
| 2007/0106513 | A1* | 5/2007 | Boillot et al. | 704/260 |
| 2007/0233472 | A1* | 10/2007 | Sinder et al. | 704/219 |
| 2013/0132069 | A1* | 5/2013 | Wouters et al. | 704/8 |
| 2014/0188480 | A1* | 7/2014 | Bangalore et al. | 704/260 |

OTHER PUBLICATIONS

Airaksinen, Analysis/Synthesis Comparison of Vocoders Utilized in Statistical Parametric Speech Synthesis, Aalto University, School of Electrical Engineering, Nov. 2012.
King, An Introduction to Statistical Parametric Speech Synthesis, Sadhana, vol. 36, Part 5, Oct. 2011.
King, Introduction to Speech Synthesis, Centre for Speech Technology Research, Informatics Forum.
Sorin, Psychoacoustic Segment Scoring for Multi-Form Speech Synthesis, Speech Technologies, IBM Haifa Research Lab, Haifa, Israel, Text-to-Speech Research, Nuance Communication, Merelbeke, Belgium.

* cited by examiner

*Primary Examiner* — Qian Yang
(74) *Attorney, Agent, or Firm* — Seyfarth Shaw LLP; Ilan N. Barzilay

(57) ABSTRACT

In a text-to-speech (TTS) system, a database including sample speech units for unit selection may be include both units represented by sample audio segments as well as parametric representations of units created by Hidden Markov Models (HMMs). Inclusion of parametric representations in the database may reduce the storage necessary to maintain the database. The parametric representations may be configured to match a voice of the audio segments. The parametric representations may correspond to phonetic units that are less frequently encountered in TTS processing, such as rare diphones or phonemes corresponding to foreign languages. Multiple foreign language HMM models may be used to enable polyglot synthesis with a reduction in storage capacity requirements. Parametrically stored speech units may be combined with speech segments generated during processing time by a parametric model.

20 Claims, 5 Drawing Sheets

HYBRID UNIT SELECTION / PARAMETRIC TTS SYSTEM

BACKGROUND

Human-computer interactions have progressed to the point where computing devices can render spoken language output to users based on textual sources. In such text-to-speech (TTS) systems, a device converts text into an audio waveform that is recognizable as speech corresponding to the input text. TTS systems may provide spoken output to users in a number of applications, enabling a user to receive information from a device without necessarily having to rely on tradition visual output devices, such as a monitor or screen. A TTS process may be referred to as speech synthesis or speech generation.

Speech synthesis may be used by computers, hand-held devices, telephone computer systems, kiosks, automobiles, and a wide variety of other devices to improve human-computer interactions.

BRIEF DESCRIPTION OF DRAWINGS

For a more complete understanding of the present disclosure, reference is now made to the following description taken in conjunction with the accompanying drawings.

DETAILED DESCRIPTION

In certain distributed text-to-speech (TTS) systems a powerful centralized server may perform TTS processing using a large speech unit database to produce high-quality results. A local device may also be configured with a smaller speech unit database to produce high-quality results for certain text, but due to storage and other operational configurations, a local device may not include as large a speech unit database that is available with a remote device. This may result in a local device providing high quality output for certain speech units but lower quality output for other speech units, particularly rarely used speech units, or occasional text of one language intermingled with text of another, primary language being processed by the TTS system.

Offered is a system and method to perform certain TTS processing on devices using a combination of speech synthesis techniques. The TTS system receives and analyzes text to break down the text into linguistic units (such as phonemes, diphones, triphones, syllables, words, etc.). The linguistic units are then synthesized in some form to create audio corresponding to what the text should sound like when spoken. Audio may be synthesized through unit selection, where the TTS system selects from among prerecorded audio segments corresponding to linguistic units and combines them together into the output audio. Audio may also be synthesized through parametric synthesis, where the TTS system sends a computerized voice generator, sometimes called a vocoder, a set of parameters (such as volume, frequency, length, etc.) which the generator uses to create the output audio. A TTS device may include a unit selection database including speech units corresponding to certain linguistic units. The database may be configured to include speech units for certain frequently used linguistic units or for linguistic units that provide poor results with other speech synthesis techniques. A TTS device may also include a model for parametric representations of other linguistic units. The speech units from the speech unit database and the representations generated from the parametric models may be combined to output speech.

Figure 1:
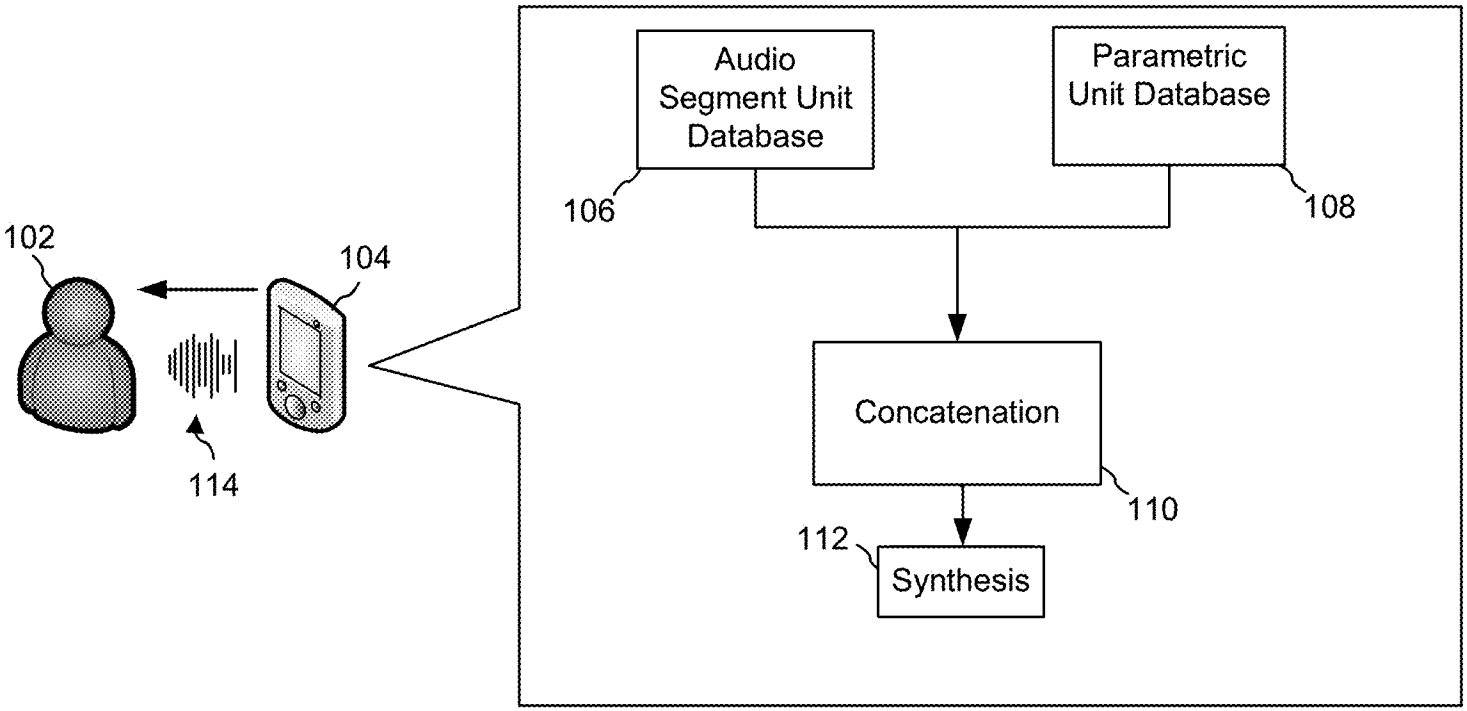
FIG. 1 illustrates a hybrid TTS system according to one aspect of the present disclosure.

An example of a hybrid TTS device according to one aspect of the present disclosure is shown in FIG. 1. A TTS device 104 is configured with an audio segment unit database 106 and parametric unit database 108. Received text (not shown) is processed by the TTS device 104 to identify speech units in each database 106 and 108. The desired speech units from those databases are concatenated together in concatenation module 110. As explained further below, the concatenation may occur in the parametric domain or in the time domain. The concatenated speech may then be synthesized in module 112 and output to a user 102 in the form of audio data comprising speech 114. Speech may also be concatenated using parametric speech based on a model, as explained below, and speech units configured to match parameterized speech.

Figure 2:
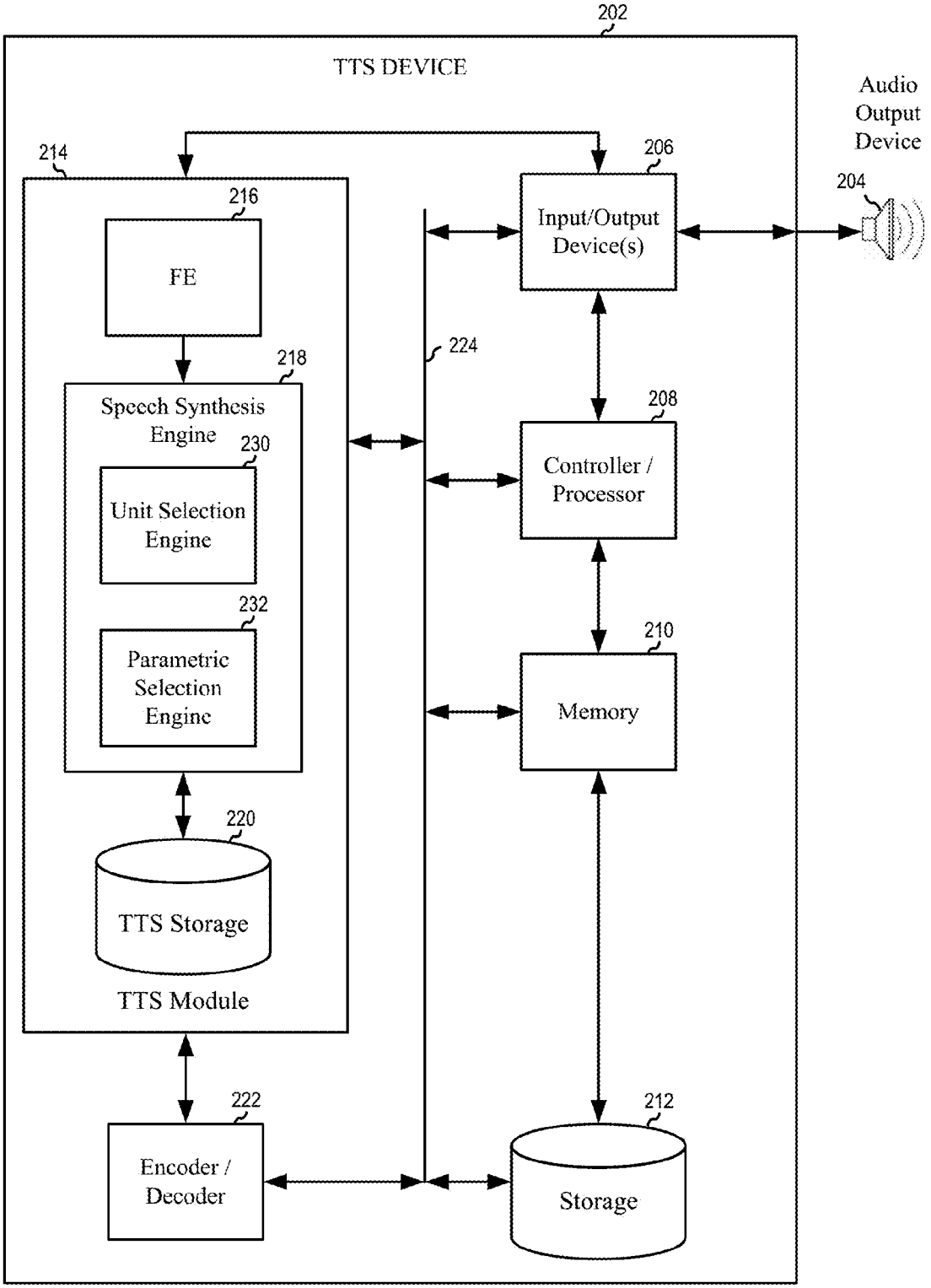
FIG. 2 is a block diagram conceptually illustrating a device for text-to-speech processing according to one aspect of the present disclosure.

FIG. 2 shows a text-to-speech (TTS) device 202 for performing speech synthesis. Aspects of the present disclosure include computer-readable and computer-executable instructions that may reside on the TTS device 202. FIG. 2 illustrates a number of components that may be included in the TTS device 202, however other non-illustrated components may also be included. Also, some of the illustrated components may not be present in every device capable of employing aspects of the present disclosure. Further, some components that are illustrated in the TTS device 202 as a single component may also appear multiple times in a single device. For example, the TTS device 202 may include multiple input/output devices 206 or multiple controllers/processors 208.

Multiple TTS devices may be employed in a single speech synthesis system. In such a multi-device system, the TTS devices may include different components for performing different aspects of the speech synthesis process. The multiple devices may include overlapping components. The TTS device as illustrated in FIG. 2 is exemplary, and may be a stand-alone device or may be included, in whole or in part, as a component of a larger device or system.

The teachings of the present disclosure may be applied within a number of different devices and computer systems, including, for example, general-purpose computing systems, server-client computing systems, mainframe computing systems, telephone computing systems, laptop computers, cellular phones, personal digital assistants (PDAs), tablet computers, other mobile devices, etc. The TTS device 202 may also be a component of other devices or systems that may provide speech synthesis functionality such as automated teller machines (ATMs), kiosks, global positioning systems (GPS), home appliances (such as refrigerators, ovens, etc.), vehicles (such as cars, busses, motorcycles, etc.), and/or ebook readers, for example.

As illustrated in FIG. 2, the TTS device 202 may include an audio output device 204 for outputting speech processed by the TTS device 202 or by another device. The audio output device 204 may include a speaker, headphones, or other suitable component for emitting sound. The audio output device 204 may be integrated into the TTS device 202 or may be separate from the TTS device 202. The TTS device 202 may also include an address/data bus 224 for conveying data among components of the TTS device 202. Each component within the TTS device 202 may also be directly connected to other components in addition to (or instead of) being connected to other components across the bus 224. Although certain components are illustrated in FIG. 2 as directly connected, these connections are illustrative only and other components may be directly connected to each other (such as the TTS module 214 to the controller/processor 208).

The TTS device 202 may include a controller/processor 208 that may be a central processing unit (CPU) for processing data and computer-readable instructions and a memory 210 for storing data and instructions. The controller/processor 208 may include a digital signal processor for generating audio data corresponding to speech. The memory 210 may include volatile random access memory (RAM), non-volatile read only memory (ROM), and/or other types of memory. The TTS device 202 may also include a data storage component 212, for storing data and instructions. The data storage component 212 may include one or more storage types such as magnetic storage, optical storage, solid-state storage, etc. The TTS device 202 may also be connected to removable or external memory and/or storage (such as a removable memory card, memory key drive, networked storage, etc.) through the input/output device 206. Computer instructions for processing by the controller/processor 208 for operating the TTS device 202 and its various components may be executed by the controller/processor 208 and stored in the memory 210, storage 212, external device, or in memory/storage included in the TTS module 214 discussed below. Alternatively, some or all of the executable instructions may be embedded in hardware or firmware in addition to or instead of software. The teachings of this disclosure may be implemented in various combinations of software, firmware, and/or hardware, for example.

The TTS device 202 includes input/output device(s) 206. A variety of input/output device(s) may be included in the device. Example input devices include a microphone, a touch input device, keyboard, mouse, stylus or other input device. Example output devices, such as an audio output device 204 (pictured as a separate component) include a speaker, visual display, tactile display, headphones, printer or other output device. The input/output device 206 may also include an interface for an external peripheral device connection such as universal serial bus (USB), FireWire, Thunderbolt or other connection protocol. The input/output device 206 may also include a network connection such as an Ethernet port, modem, etc. The input/output device 206 may also include a wireless communication device, such as radio frequency (RF), infrared, Bluetooth, wireless local area network (WLAN) (such as WiFi), or wireless network radio, such as a radio capable of communication with a wireless communication network such as a Long Term Evolution (LTE) network, WiMAX network, 3G network, etc. Through the input/output device 206 the TTS device 202 may connect to a network, such as the Internet or private network, which may include a distributed computing environment.

The device may also include a TTS module 214 for processing textual data into audio waveforms including speech. The TTS module 214 may be connected to the bus 224, input/output device(s) 206, audio output device 204, encoder/decoder 222, controller/processor 208 and/or other component of the TTS device 202. The textual data may originate from an internal component of the TTS device 202 or may be received by the TTS device 202 from an input device such as a keyboard or may be sent to the TTS device 202 over a network connection. The text may be in the form of sentences including text, numbers, and/or punctuation for conversion by the TTS module 214 into speech. The input text may also include special annotations for processing by the TTS module 214 to indicate how particular text is to be pronounced when spoken aloud. Textual data may be processed in real time or may be saved and processed at a later time.

The TTS module 214 includes a TTS front end (FE) 216, a speech synthesis engine 218 and TTS storage 220. The FE 216 transforms input text data into a symbolic linguistic representation for processing by the speech synthesis engine 218. The speech synthesis engine 218 compares the annotated phonetic units in the symbolic linguistic representation to models and information stored in the TTS storage 220 for converting the input text into speech. The FE 216 and speech synthesis engine 218 may include their own controller(s)/processor(s) and memory or they may use the controller/processor 208 and memory 210 of the TTS device 202, for example. Similarly, the instructions for operating the FE 216 and speech synthesis engine 218 may be located within the TTS module 214, within the memory 210 and/or storage 212 of the TTS device 202, or within another component or external device.

Text input into a TTS module 214 may be sent to the FE 216 for processing. The front-end may include modules for performing text normalization, linguistic analysis, and linguistic prosody generation. During text normalization, the FE processes the text input and generates standard text, converting such things as numbers, abbreviations (such as Apt., St., etc.), symbols ($, %, etc.) and other non-standard text into the equivalent of written out words.

During linguistic analysis the FE 216 analyzes the language in the normalized text to generate a sequence of phonetic units corresponding to the input text. This process may be referred to as phonetic transcription. Phonetic units include symbolic representations of sound units to be eventually combined and output by the TTS device 202 as speech. Various sound units may be used for dividing text for purposes of speech synthesis. A TTS module 214 may process speech based on phonemes (individual sounds), half-phonemes, di-phones (the last half of one phoneme coupled with the first half of the adjacent phoneme), bi-phones (two consecutive phonemes), syllables, words, phrases, sentences, or other units. Each word of the normalized text may be mapped to one or more phonetic units. Such mapping may be performed using a language dictionary stored in the TTS device 202, for example in the TTS storage module 220. The linguistic analysis performed by the FE 216 may also identify different grammatical components such as prefixes, suffixes, phrases, punctuation, syntactic boundaries, or the like. Such grammatical components may be used by the TTS module 214 to craft a natural sounding audio waveform output. The language dictionary may also include letter-to-sound rules and other tools that may be used to pronounce previously unidentified words or letter combinations that may be encountered by the TTS module 214. Generally, the more information included in the language dictionary, the higher quality the speech output.

Based on the linguistic analysis the FE 216 may then perform linguistic prosody generation where the phonetic units are annotated with desired prosodic characteristics, also called acoustic features, which indicate how the desired phonetic units are to be pronounced in the eventual output speech. During this stage the FE 216 may consider and incorporate any prosodic annotations that accompanied the text input to the TTS module 214. Such acoustic features may include pitch, energy, duration, and the like. Application of acoustic features may be based on prosodic models available to the TTS module 214. Such prosodic models indicate how specific phonetic units are to be pronounced in certain circumstances. A prosodic model may consider, for example, a phoneme's position in a syllable, a syllable's position in a word, a word's position in a sentence or phrase, neighboring phonetic units, etc. As with the language dictionary, prosodic models with more information may result in higher quality speech output than prosodic models with less information.

The output of the FE 216, referred to as a symbolic linguistic representation, may include a sequence of phonetic units annotated with prosodic characteristics. This symbolic linguistic representation may be sent to a speech synthesis engine 218, also known as a synthesizer, for conversion into an audio waveform of speech for eventual output to an audio output device 204 and eventually to a user. The speech synthesis engine 218 may be configured to convert the input text into high-quality natural-sounding speech in an efficient manner. Such high-quality speech may be configured to sound as much like a human speaker as possible, or may be configured to be understandable to a listener without attempts to mimic a precise human voice.

A speech synthesis engine 218 may perform speech synthesis using one or more different methods. In one method of synthesis called unit selection, described further below, a unit selection engine 230 matches a database of recorded speech against the symbolic linguistic representation created by the FE 216. The unit selection engine 230 matches the symbolic linguistic representation against spoken audio units in the database. Matching units are selected and concatenated together to form a speech output. Each unit includes an audio waveform corresponding with a phonetic unit, such as a short .wav file of the specific sound, along with a description of the various acoustic features associated with the .wav file (such as its pitch, energy, etc.), as well as other information, such as where the phonetic unit appears in a word, sentence, or phrase, the neighboring phonetic units, etc. Using all the information in the unit database, a unit selection engine 230 may match units to the input text to create a natural sounding waveform. The unit database may include multiple examples of phonetic units to provide the TTS device 202 with many different options for concatenating units into speech. One benefit of unit selection is that, depending on the size of the database, a natural sounding speech output may be generated. The larger the unit database, the more likely the TTS device 202 will be able to construct natural sounding speech.

In another method of synthesis called parametric synthesis, also described further below, parameters such as frequency, volume, noise, are varied by a parametric TTS engine 232, digital signal processor or other audio generation device to create an artificial speech waveform output. Parametric synthesis may use an acoustic model and various statistical techniques to match a symbolic linguistic representation with desired output speech parameters. Parametric synthesis may include the ability to be accurate at high processing speeds, as well as the ability to process speech without large databases associated with unit selection, but also typically produces an output speech quality that may not match that of unit selection. Unit selection and parametric techniques may be performed individually or combined together and/or combined with other synthesis techniques to produce speech audio output.

Parametric speech synthesis may be performed as follows. A TTS module 214 may include an acoustic model, or other models, which may convert a symbolic linguistic representation into a synthetic acoustic waveform of the text input based on audio signal manipulation. The acoustic model includes rules which may be used by the parametric TTS engine 232 to assign specific audio waveform parameters to input phonetic units and/or prosodic annotations. The rules may be used to calculate a score representing a likelihood that a particular audio output parameter(s) (such as frequency, volume, etc.) corresponds to the portion of the input symbolic linguistic representation from the FE 216.

The parametric TTS engine 232 may use a number of techniques to match speech to be synthesized with input phonetic units and/or prosodic annotations. One common technique is using Hidden Markov Models (HMMs). HMMs may be used to determine probabilities that audio output should match textual input. HMMs may be used to translate from parameters from the linguistic and acoustic space to the parameters to be used by a vocoder (a digital voice encoder) to artificially synthesize the desired speech. Using HMMs, a number of states are presented, in which the states together represent one or more potential acoustic parameters to be output to the vocoder and each state is associated with a model, such as a Gaussian mixture model. Transitions between states may also have an associated probability, representing a likelihood that a current state may be reached from a previous state. Sounds to be output may be represented as paths between states of the HMM and multiple paths may represent multiple possible audio matches for the same input text. Each portion of text may be represented by multiple potential states corresponding to different known pronunciations of phonemes and their parts (such as the phoneme identity, stress, accent, position, etc.). An initial determination of a probability of a potential phoneme may be associated with one state. As new text is processed by the speech synthesis engine 218, the state may change or stay the same, based on the processing of the new text. For example, the pronunciation of a previously processed word might change based on later processed words. A Viterbi algorithm may be used to find the most likely sequence of states based on the processed text. The HMMs may generate speech in parametrized form including parameters such as fundamental frequency (f0), noise envelope, spectral envelope, etc. that are translated by a vocoder into audio segments. The output parameters may be configured for particular vocoders such as a STRAIGHT vocoder, TANDEM-STRAIGH vocoder, HNM (harmonic plus noise) based vocoders, CELP (code-excited linear prediction) vocoders, GlottHMM vocoders, HSM (harmonic/stochastic model) vocoders, or others.

Figure 3:
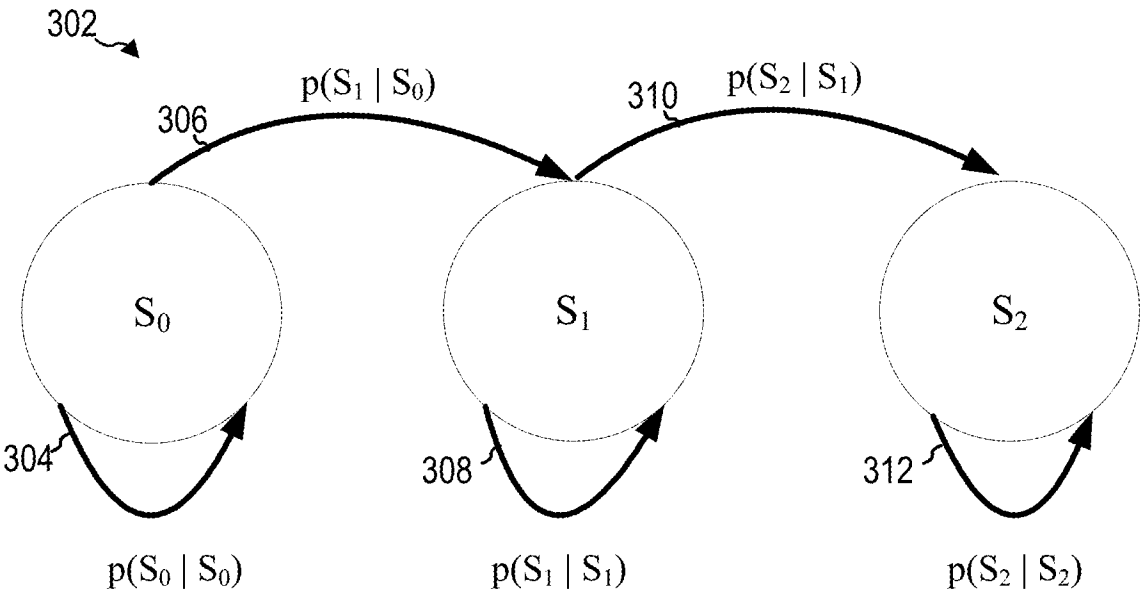
FIG. 3 illustrates speech synthesis using a Hidden Markov Model according to one aspect of the present disclosure.

An example of HMM processing for speech synthesis is shown in FIG. 3. A sample input phonetic unit, for example, phoneme /E/, may be processed by a parametric TTS engine 232. The parametric TTS engine 232 may initially assign a probability that the proper audio output associated with that phoneme is represented by state $S_0$ in the Hidden Markov Model illustrated in FIG. 3. After further processing, the speech synthesis engine 218 determines whether the state should either remain the same, or change to a new state. For example, whether the state should remain the same 304 may depend on the corresponding transition probability (written as $P(S_0|S_0)$, meaning the probability of going from state $S_0$ to $S_0$) and how well the subsequent frame matches states $S_0$ and $S_1$. If state $S_1$ is the most probable, the calculations move to state $S_1$ and continue from there. For subsequent phonetic units, the speech synthesis engine 218 similarly determines whether the state should remain at $S_1$, using the transition probability represented by $P(S_1|S_1)$ 308, or move to the next state, using the transition probability $P(S_2|S_1)$ 310. As the processing continues, the parametric TTS engine 232 continues calculating such probabilities including the probability 312 of remaining in state $S_2$ or the probability of moving from a state of illustrated phoneme /E/ to a state of another phoneme. After processing the phonetic units and acoustic features for state $S_2$, the speech recognition may move to the next phonetic unit in the input text.

The probabilities and states may be calculated using a number of techniques. For example, probabilities for each state may be calculated using a Gaussian model, Gaussian mixture model, or other technique based on the feature vectors and the contents of the TTS storage 220. Techniques such as maximum likelihood estimation (MLE) may be used to estimate the probability of parameter states.

In addition to calculating potential states for one audio waveform as a potential match to a phonetic unit, the parametric TTS engine 232 may also calculate potential states for other potential audio outputs (such as various ways of pronouncing phoneme /E/) as potential acoustic matches for the phonetic unit. In this manner multiple states and state transition probabilities may be calculated.

The probable states and probable state transitions calculated by the parametric TTS engine 232 may lead to a number of potential audio output sequences. Based on the acoustic model and other potential models, the potential audio output sequences may be scored according to a confidence level of the parametric TTS engine 232. The highest scoring audio output sequence, including a stream of parameters to be synthesized, may be chosen and digital signal processing may be performed by a vocoder or similar component to create an audio output including synthesized speech waveforms corresponding to the parameters of the highest scoring audio output sequence and, if the proper sequence was selected, also corresponding to the input text.

Unit selection speech synthesis may be performed as follows. Unit selection includes a two-step process. First a unit selection engine 230 determines what speech units to use and then it combines them so that the particular combined units match the desired phonemes and acoustic features and create the desired speech output. A TTS device 202 may be configured with a speech unit database for use in unit selection. The speech unit database may be stored in TTS storage 220, in storage 212, or in another storage component. The speech unit database includes recorded speech utterances with the utterances' corresponding text aligned to the utterances. The speech unit database may include many hours of recorded speech (in the form of audio waveforms, feature vectors, or other formats), which may occupy a significant amount of storage in the TTS device 202. The unit samples in the speech unit database may be classified in a variety of ways including by phonetic unit (phoneme, diphone, word, etc.), linguistic prosodic label, acoustic feature sequence, speaker identity, etc. The sample utterances may be used to create mathematical models corresponding to desired audio output for particular speech units. When matching a symbolic linguistic representation the speech synthesis engine 218 may attempt to select a unit in the speech unit database that most closely matches the input text (including both phonetic units and prosodic annotations). Generally the larger the speech unit database the better the speech synthesis may be achieved by virtue of the greater number of unit samples that may be selected to form the precise desired speech output. Multiple selected units may then be combined together to form an output audio waveform representing the speech of the input text.

Audio waveforms including the speech output from the TTS module 214 may be sent to an audio output device 204 for playback to a user or may be sent to the input/output device 206 for transmission to another device, such as another TTS device 202, for further processing or output to a user. Audio waveforms including the speech may be sent in a number of different formats such as a series of feature vectors, uncompressed audio data, or compressed audio data. For example, audio speech output may be encoded and/or compressed by the encoder/decoder 222 prior to transmission. The encoder/decoder 222 may be customized for encoding and decoding speech data, such as digitized audio data, feature vectors, etc. The encoder/decoder 222 may also encode non-TTS data of the TTS device 202, for example using a general encoding scheme such as .zip, etc. The functionality of the encoder/decoder 222 may be located in a separate component, as illustrated in FIG. 2, or may be executed by the controller/processor 208, TTS module 214, or other component, for example.

Other information may also be stored in the TTS storage 220 for use in speech recognition. The contents of the TTS storage 220 may be prepared for general TTS use or may be customized to include sounds and words that are likely to be used in a particular application. For example, for TTS processing by a global positioning system (GPS) device, the TTS storage 220 may include customized speech specific to location and navigation. In certain instances the TTS storage 220 may be customized for an individual user based on his/her individualized desired speech output. For example a user may prefer a speech output voice to be a specific gender, have a specific accent, speak at a specific speed, have a distinct emotive quality (e.g., a happy voice), or other customizable characteristic. The speech synthesis engine 218 may include specialized databases or models to account for such user preferences. A TTS device 202 may also be configured to perform TTS processing in multiple languages. For each language, the TTS module 214 may include specially configured data, instructions and/or components to synthesize speech in the desired language(s). To improve performance, the TTS module 214 may revise/update the contents of the TTS storage 220 based on feedback of the results of TTS processing, thus enabling the TTS module 214 to improve speech recognition beyond the capabilities provided in the training corpus.

Figure 4:
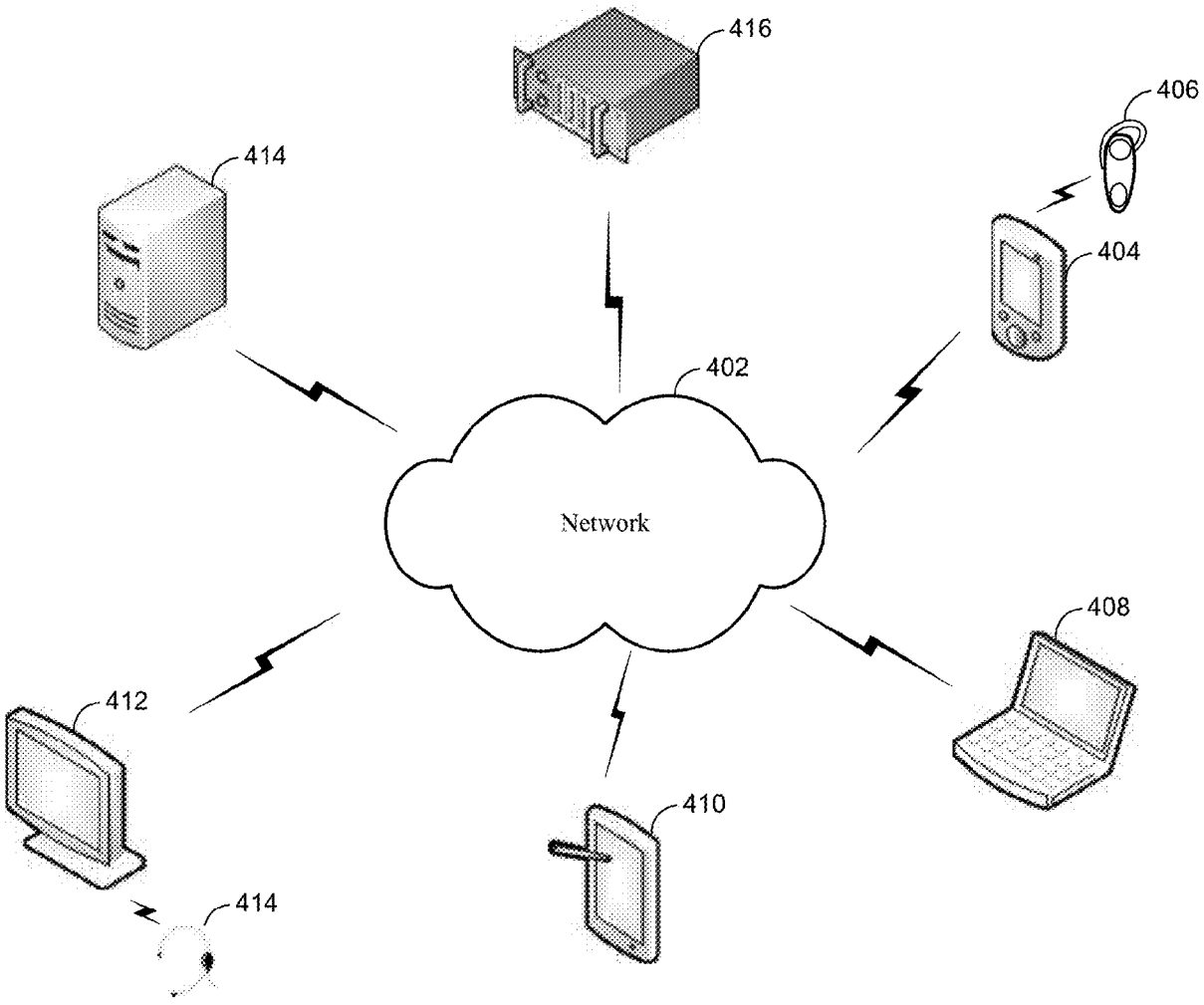
FIG. 4 illustrates a computer network for use with text-to-speech processing according to one aspect of the present disclosure.

Multiple TTS devices 202 may be connected over a network. As shown in FIG. 4 multiple devices may be connected over network 402. Network 402 may include a local or private network or may include a wide network such as the internet. Devices may be connected to the network 402 through either wired or wireless connections. For example, a wireless device 404 may be connected to the network 402 through a wireless service provider. Other devices, such as computer 412, may connect to the network 402 through a wired connection. Other devices, such as laptop 408 or tablet computer 410 may be capable of connection to the network 402 using various connection methods including through a wireless service provider, over a WiFi connection, or the like. Networked devices may output synthesized speech through a number of audio output devices including through headsets 406 or 414. Audio output devices may be connected to networked devices either through a wired or wireless connection. Networked devices may also include embedded audio output devices, such as an internal speaker in laptop 408, wireless device 404 or table computer 410.

In certain TTS system configurations, a combination of devices may be used. For example, one device may receive text, another device may process text into speech, and still another device may output the speech to a user. For example, text may be received by a wireless device 404 and sent to a computer 414 or server 416 for TTS processing. The resulting speech audio data may be returned to the wireless device 404 for output through headset 406. Or computer 412 may partially process the text before sending it over the network 402. Because TTS processing may involve significant computational resources, in terms of both storage and processing power, such split configurations may be employed where the device receiving the text/outputting the processed speech may have lower processing capabilities than a remote device and higher quality TTS results are desired. The TTS processing may thus occur remotely with the synthesized speech results sent to another device for playback near a user.

As discussed above, when high quality speech results are desired, unit selection speech synthesis may be preferred. One drawback to unit selection is the large size of a unit database that is configured to obtain high quality results. Speech samples (such as audio waveform files) are storage intensive, and can cause a unit database to use significant storage on a TTS device. Parametric speech synthesis, while generally resulting in lower quality speech results, does not require the same large database as unit selection. To balance between quality results and database storage speech synthesis may be performed using a combination of unit selection and parametric synthesis.

For example, a smaller unit database may be configured on a TTS device, where the smaller database may include unit samples (and corresponding storage intensive audio samples) for only certain frequently used phonetic units. As testing reveals that a small portion of a large TTS unit database (for example, 10-20% of units) is used for a majority of TTS processing (for example, 80-90%), a smaller local TTS unit database may provide sufficient quality results for most user experience without expending the same amount of storage resources that might be expended for a complete, much larger TTS database. Units which are not sufficiently represented in the smaller unit database to synthesize speech at a desired quality may be synthesized using parametric/HMM techniques. In particular, rarely used phonetic units, for example phonetic units in foreign words that may appear in text of a different primary language (for example, Spanish words appearing in English text), may be synthesized using parametric techniques. Thus hybrid speech synthesis may be employed to achieve sufficiently high quality using less storage than a perhaps more robust unit selection approach. Hybrid speech synthesis may be employed by a centralized TTS server or by individual local devices which may be configured with smaller unit databases for hybrid speech synthesis.

In one aspect of the present disclosure, the unit database for frequently used units may be combined with a fully parametric speech synthesis system. A controller, such as the controller/processor 208 or a controller internal to a TTS module 214, may determine whether a particular unit of input text is synthesized using the audio segments in the unit database or using the parametric system. Individual units may then be concatenated together to form a speech output.

In one aspect of the present disclosure a parametric database may be constructed for hybrid speech synthesis. The parametric database may be similar to a unit database in that both include records of phonetic units and their respective acoustic parameters, only the parametric database may store phonetic units and their acoustic parameters (such as duration, frequency contour, power contour, etc.) as created through an HMM process described above. As the parametric database may store phonetic units in parametric form (that is, in a form of acoustic parameters that may be passed to a vocoder for artificial synthesis) the individual entries in the parametric database for particular phonetic units would be significantly smaller than entries in a typical unit database which include larger audio waveform samples.

The HMM results to be stored in the parametric database may be configured to precisely match desired phonetic units and their respective parameters as desired. For example, the parametric database may include phonetic units that are otherwise not robustly included in a smaller waveform unit database, such as rarely used or foreign phonetic units. HMM parameters and/or HMM models may be specifically configured and adjusted to precisely create desired synthesized speech units. As HMM parameters may be more precisely adjusted by a TTS device or system, specific phonetic units and corresponding parameters may be crafted for inclusion into the parametric database and eventual synthesis by a vocoder. For example, parameters/linguistic features such as duration, power, position of the phonetic unit within a sentence or word, etc. may be individually adjusted for a particular phonetic unit to create customized parameters which may be passed to the vocoder to obtain customized vocoded phonetic units. Those vocoded phonetic units may then be concatenated with audio waveform segments from a typical unit selection database.

Customizing HMM units in this manner may be desired as adjusting phonetic units in parametric form to obtain a desired output provides more flexibility than relying exclusively on pre-recorded audio segments. HMM units may be aligned toward target models to obtain a desired result. For example, when a target prosodic model applied by a FE 216 calls for a phonetic unit (such as a diphone, phoneme, etc.) that has a specific length, power, or other parameter, the parameters of a phonetic unit may be specifically configured to obtain the output, thereby matching the output speech to the prosodic model.

In one aspect, instead of (or in addition to) altering an HMM model, a target for an HMM may be adjusted. For example, taking an HMM model, the target specification of a phonetic unit may be changed. A target specification for a unit in an HMM includes a number of parameters such as length, power, etc. The input for the particular unit HMM may be changed to alter the vocoder parameter output of the HMM.

In another aspect, HMM created phonetic units may be stored in a unit database in the form of vocoder parameters. In this manner parametric units for synthesis by a vocoder may be stored along with the typical pre-recorded speech segments in a unit database. As the parametric units take up less storage space than pre-recorded speech segments, constructing a unit database in this manner may reduce the amount of storage resources consumed by the database. The differently sourced audio segments may then be concatenated together using vocoder parameters (i.e., before the vocoder parameters are synthesized) which may be considered in the parametric domain, or in the audio/time domain (i.e., after the vocoder parameters are synthesized).

Depending on the vocoder(s) employed by the TTS device, certain phonetic units may be preferably configured as HMM configured parametric units rather than as prerecorded waveform speech units. This may depend on the configuration and quality of the vocoder synthesis output. Phonetic units which may have a sufficient quality level when artificially synthesized by a vocoder (such as sounds with strong stationary parts like vowels, voiced consonants, etc.) may be selected for this approach. In this manner a TTS device may be configured with a particular quality/storage tradeoff so that phonetic units which achieve a sufficient quality may be stored as parametric units and synthesized by a vocoder and removed from the pre-recorded speech segment unit database, thereby reducing the size of the unit database without an undesirable reduction in the overall quality of the synthesized speech output. In another aspect, a quality metric may be configured for a TTS device or operation to adjust the number of phonetic units which are represented by pre-recorded audio segments as in a traditional unit database and which are created through an HMM parametric approach. Thereby increasing the number of pre-recorded audio segments when higher quality speech is desired and reducing the number of pre-recorded audio segments when lower use of storage resources is desired. In another aspect multiple vocoders may be employed by a TTS device and chosen for synthesis of particular phonetic units depending on the particular output of the vocoder, thereby further improving the quality of the overall synthesized speech output.

Quality control may present an issue when concatenating audio segments from a unit database with parametrically synthesized speech units. This is due to a more natural sound resulting from the use of audio segments and a more mechanical sound resulting from parametrically synthesized speech units. In one aspect, to smooth this concatenation the speech units may be concatenated in the time domain, but this may result in a significant difference in signal quality. To reduce that effect, a unit selection system's output may be processed by a vocoder to make the output sound more like vocoded speech, which may concatenate better with parametrically synthesized speech. This vocoder processing may occur at the time of processing or prior to building of the audio segments in the unit selection database. If done at the database level, source audio recordings in a unit selection database may be passed through a vocoder and then restored in the unit database. In this manner, the original audio wave segments may be made to sound as if they came from a vocoder. This process may reduce signal quality, or may add sounds that are characteristic to vocoded speech, such as a natural stationary buzz of a vocoder, to all units that are to be used for the speech synthesis, but will retain many of the expressive aspects associated with unit selection speech synthesis. Ultimately, this may smooth the eventual speech output from the point of view of a user, who will not experience vocoder effects during certain phonetic units but not others. In another aspect, speech units may be concatenated in a vocoder parameter domain. In this aspect the unit database may include units are represented by vocoder parameters rather than audio segments. Those parameters may then be concatenated and synthesized using vocoder synthesis. In another aspect, speech units may be concatenated in a time domain, that is combined as formed audio signals as they appear in time.

Various techniques may be used to concatenate speech units. One technique, called overlap and add, combines speech units representing partially overlapping linguistic units. For example, take synthesizing the word "hello." If there are three speech units representing this word which each slightly overlap with the next (the first unit representing the sound "he", the second representing the sound "el", and the third representing the sound "lo") they may be combined as follows. The first and second units are combined by creating an audio segment with three sections. The first section incorporates the full portion of the first unit which does not overlap with the second unit (for example, the "h" sound). The second section incorporates the portions of the first and second units which overlap (for example, the "e" sound). The third section incorporates the full portion of the second unit which does not overlap with the first unit (for example, the "l" sound). To make up the synthesized audio segment, for the first section only portions of the first unit are used and for the third sections only portions of the second unit are used. During the second portion, however, sliding values of the first and second unit are used. At the beginning of the second portion, the full value of the first unit is used with that value tapering to zero by the end of the second portion. The used portion of the first unit is added to the used portion of the second unit. The used portion of the second unit during the second portion starts at zero at the beginning of the second portion and grows to full by the end of the second portion. Thus the first and second units are concatenated to synthesize the first portion of the word hello. The second and third units may be concatenated in the same manner to synthesize the rest of the word.

Another technique for concatenation involves matching pitch marks of unit segments. In this technique, phases of audio segments are matched and concatenated to provide a smooth transition between speech units, thus improving the ultimate synthesized speech. For example, to concatenate two sinusoids, the peaks of the sinusoids are matched and then the sinusoids may be concatenated. Other concatenation techniques may also be used.

In one aspect of the present disclosure, the parametric units in a database may include phonetic units that are used to generate words in a foreign language that is different from a primary language of the TTS processing. For example, a TTS device that may be primarily configured to perform TTS processing in English may include parametric units used to synthesize words in French, Spanish, or other languages. While configuring a traditional unit selection system with foreign phonetic units may be undesirably large, a hybrid system incorporating parametrically created foreign units may not suffer from the same size drawbacks. Different HMM models may be used to create parametric units for different languages.

The parametric units may be configured so that eventual synthesis by a vocoder results in pronunciation of the foreign units (or other parametric units) that matches the voice of the pre-recorded speech units. For example, if the pre-recorded speech units are of a male speaker of American English, the synthesis of the foreign units may match the same pronunciation (rather than, for example, Spanish words being spoken by a native Spanish speaker). In this manner a modified polyglot TTS system may be implemented. The above example is meant to be illustrative only, as the pronunciation of parametrically configured speech units may be configured as desired.

In one aspect, hybrid TTS processing may also be combined with distributed TTS processing. Where a portion of text to be converted uses units available in a local database, that portion of text may be processed locally. Where a portion of text to be converted uses units not available in a local database, the local device may obtain the units from a remote device. The units from the remote device may then concatenated with the local units for construction of the audio speech for output to a user. Such combining of unit selection speech synthesis techniques are described in copending application U.S. patent application Ser. No. 13/740,762, filed on Jan. 14, 2013, entitled "Distributed Speech Unit Inventory for TTS Systems," which is hereby incorporated by reference in its entirety. The units may be pre-recorded units of a typical unit database or may be parametric units such as those described above. In one example of a distributed TTS system a local TTS device may include a list of units and their corresponding acoustic features that are available at a remote TTS device and whose audio files/parametric units should be retrieved from the remote device for speech synthesis.

Figure 5:
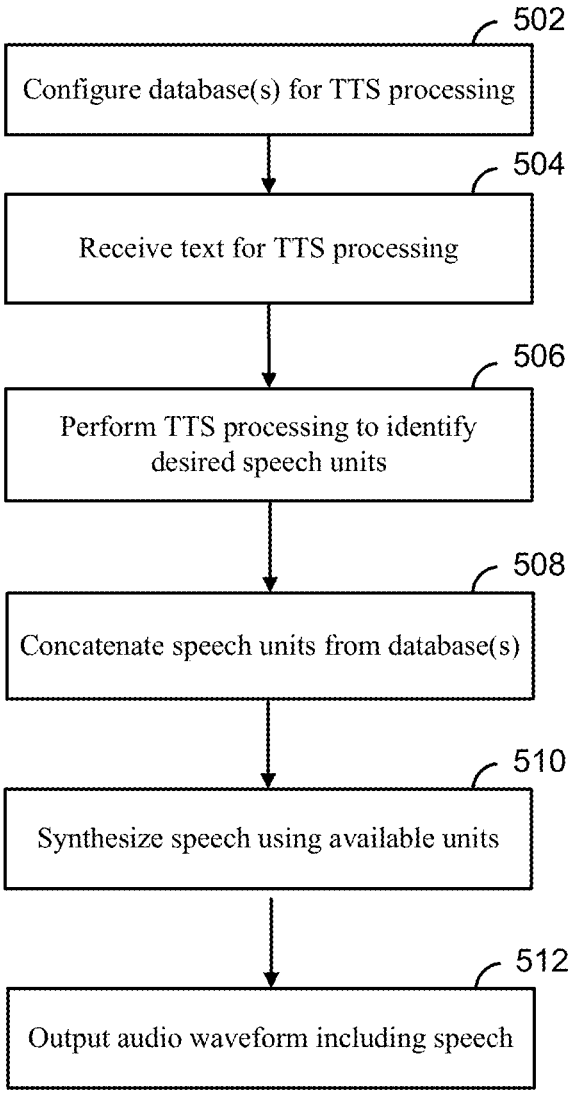
FIG. 5 illustrates performing TTS with a hybrid TTS system according to one aspect of the present disclosure.

In one aspect of the present disclosure, TTS processing may be performed as illustrated in FIG. 5. As shown in block 502, one or more unit databases may be configured for a TTS device. One database may include audio segments corresponding to certain speech units. Another database may include parametric representations corresponding to other speech units. The databases may be separate or combined. The parametric representations may correspond to speech units that are rarely used in TTS processing, such as speech units for foreign languages. A shown in block 504, the TTS device may receive text data for processing into speech. As shown in block 506, the TTS device may then perform preliminary TTS processing to identify the desired speech units to be used in speech synthesis. As shown in block 508, the TTS device may concatenate speech units from the one or more databases. The concatenation may occur in the parametric domain or the time domain. The TTS device may then perform speech synthesis using the available unit audio segments, as shown in block 510. As shown in block 512, the TTS device may then output the audio waveform including speech corresponding to the input text.

The above aspects of the present disclosure are meant to be illustrative. They were chosen to explain the principles and application of the disclosure and are not intended to be exhaustive or to limit the disclosure. Many modifications and variations of the disclosed aspects may be apparent to those of skill in the art. For example, the TTS techniques described herein may be applied to many different languages, based on the language information stored in the TTS storage.

Aspects of the present disclosure may be implemented as a computer implemented method, a system, or as an article of manufacture such as a memory device or non-transitory computer readable storage medium. The computer readable storage medium may be readable by a computer and may comprise instructions for causing a computer or other device to perform processes described in the present disclosure. The computer readable storage medium may be implemented by a volatile computer memory, non-volatile computer memory, hard drive, solid state memory, flash drive, removable disk, and/or other media.

Aspects of the present disclosure may be performed in different forms of software, firmware, and/or hardware. Further, the teachings of the disclosure may be performed by an application specific integrated circuit (ASIC), field programmable gate array (FPGA), or other component, for example.

Aspects of the present disclosure may be performed on a single device or may be performed on multiple devices. For example, program modules including one or more components described herein may be located in different devices and may each perform one or more aspects of the present disclosure. As used in this disclosure, the term "a" or "one" may include one or more items unless specifically stated otherwise. Further, the phrase "based on" is intended to mean "based at least in part on" unless specifically stated otherwise.

What is claimed is:

1. A method of performing hybrid text-to-speech processing, the method comprising:

receiving text data;

determining a sequence of linguistic units corresponding to the text data, the sequence of linguistic units comprising a first linguistic unit and a second linguistic unit;

determining to use a first parametric speech synthesis technique for the first linguistic unit, wherein the first parametric speech synthesis technique comprises synthesizing speech using a computerized voice generator;

generating a representation of the first linguistic unit using a model for the first linguistic unit and using the first parametric speech synthesis technique;

determining to use a unit selection speech synthesis technique for the second linguistic unit;

retrieving a pre-recorded speech unit for the second linguistic unit from a unit selection database, wherein the pre-recorded speech unit comprises recorded speech that has been processed with an encoder and a decoder prior to storage in the unit selection database, to configure the pre-recorded speech unit with acoustic properties consistent with speech generated by the first parametric speech synthesis technique;

concatenating the representation of the first linguistic unit and the pre-recorded speech unit to generate audio data; and causing audio corresponding to the audio data to be output using an audio speaker.

2. The method of claim 1, wherein the second linguistic unit comprises a phoneme, diphone, triphone, syllable, or word.

3. The method of claim 1, wherein the first linguistic unit corresponds to a first language and the second linguistic unit corresponds to a second language.

4. The method of claim 1, wherein the unit selection database was created using recorded speech and the model for the first linguistic unit was created using at least a portion of the recorded speech.

5. The method of claim 1, wherein the unit selection database comprises a plurality of speech units and wherein selection of the plurality of speech units is based at least in part on a quality of a representation of a corresponding linguistic unit using the parametric speech synthesis technique.

6. A method comprising:

receiving text data;

determining a sequence of linguistic units corresponding to the text data, the sequence of linguistic units comprising a first linguistic unit and a second linguistic unit;

generating a representation of the first linguistic unit using a model for the first linguistic unit and a first parametric speech synthesis technique, wherein the first parametric speech synthesis technique comprises synthesizing speech using a computerized voice generator;

retrieving a pre-recorded speech unit for the second linguistic unit from a unit selection database, wherein the pre-recorded speech unit comprises recorded speech configured with acoustic properties consistent with speech generated by the first parametric speech synthesis technique;

concatenating the representation of the first linguistic unit and the pre-recorded speech unit for the second linguistic unit to generate audio data; and causing audio corresponding to the audio data to be output using an audio speaker.

7. The method of claim 6, wherein the second linguistic unit comprises a phoneme, diphone, triphone, syllable, or word.

8. The method of claim 6, wherein the first linguistic unit corresponds to a first language and the second linguistic unit corresponds to a second language.

9. The method of claim 6, wherein the unit selection database was created using recorded speech and the model for the first linguistic unit was created using at least a portion of the recorded speech.

10. The method of claim 6, wherein the unit selection database comprises a plurality of pre-recorded speech units and wherein selection of the plurality of pre-recorded speech units is based at least in part on a quality of a representation of a corresponding linguistic unit using the parametric speech synthesis technique.

11. A computing device, comprising:

a processor;

a memory device including instructions operable to be executed by the processor to perform a set of actions, configuring the processor:

to receive text data;

to determine a sequence of linguistic units corresponding to the text data, the sequence of linguistic units comprising a first linguistic unit and a second linguistic unit;

to generate a representation of the first linguistic unit using a model for the first linguistic unit and a first parametric speech synthesis technique, wherein the first parametric speech synthesis technique comprises synthesizing speech using a computerized voice generator;

to retrieve a pre-recorded speech unit for the second linguistic unit from a unit selection database, wherein the pre-recorded speech unit comprises recorded speech configured with acoustic properties consistent with speech generated by the first parametric speech synthesis technique;

to concatenate the representation of the first linguistic unit and the pre-recorded speech unit for the second linguistic unit to generate audio data; and to cause audio corresponding to the audio data to be output using an audio speaker.

12. The computing device of claim 11, wherein the second linguistic unit comprises a phoneme, diphone, triphone, syllable, or word.

13. The computing device of claim 11, wherein the first linguistic unit corresponds to a first language and the second linguistic unit corresponds to a second language.

14. The computing device of claim 11, wherein the unit selection database was created using recorded speech and the model for the first linguistic unit was created using at least a portion of the recorded speech.

15. The computing device of claim 11, wherein the unit selection database comprises a plurality of pre-recorded speech units and wherein selection of the plurality of pre-recorded speech units is based at least in part on a quality of a representation of a corresponding linguistic unit using the parametric speech synthesis technique.

16. A non-transitory computer-readable storage medium storing processor-executable instructions for controlling a computing device, comprising:

program code to receive text data;

program code to determine a sequence of linguistic units corresponding to the text data, the sequence of linguistic units comprising a first linguistic unit and a second linguistic unit;

program code to generate a representation of the first linguistic unit using a model for the first linguistic unit and a first parametric speech synthesis technique, wherein the first parametric speech synthesis technique comprises synthesizing speech using a computerized voice generator;

program code to retrieve a pre-recorded speech unit for the second linguistic unit from a unit selection database, wherein the pre-recorded speech unit comprises recorded speech configured with acoustic properties consistent with speech generated by the first parametric speech synthesis technique;

program code to concatenate the representation of the first linguistic unit and the pre-recorded speech unit for the second linguistic unit to generate audio data; and program code to cause audio corresponding to the audio data to be output using an audio speaker.

17. The non-transitory computer-readable storage medium of claim 16, wherein the second linguistic unit comprises a phoneme, diphone, triphone, syllable, or word.

18. The non-transitory computer-readable storage medium of claim 16, wherein the first linguistic unit corresponds to a first language and the second linguistic unit corresponds to a second language.

19. The non-transitory computer-readable storage medium of claim 16, wherein the unit selection database was created using recorded speech and the model for the first linguistic unit was created using at least a portion of the recorded speech.

20. The non-transitory computer-readable storage medium of claim 16, wherein the unit selection database comprises a plurality of pre-recorded speech units and wherein selection of the plurality of pre-recorded speech units is based at least in part on a quality of a representation of a corresponding linguistic unit using the parametric speech synthesis technique.

* * * * *